US011480002B2

(12) United States Patent
Kobayashi et al.

(10) Patent No.: US 11,480,002 B2
(45) Date of Patent: Oct. 25, 2022

(54) POWER TAILGATE HAVING MANUAL OPERATION FEATURE

(71) Applicant: Toyota Motor Engineering & Manufacturing North America, Inc., Plano, TX (US)

(72) Inventors: Jun Kobayashi, Novi, MI (US); Norman C. Kerr, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 162 days.

(21) Appl. No.: 16/674,041

(22) Filed: Nov. 5, 2019

(65) Prior Publication Data

US 2021/0131160 A1 May 6, 2021

(51) Int. Cl.
*E05F 15/614* (2015.01)
*E05F 11/12* (2006.01)
*E05F 1/00* (2006.01)

(52) U.S. Cl.
CPC ..... *E05F 15/614* (2015.01); *E05F 1/002* (2013.01); *E05F 11/12* (2013.01); *E05Y 2900/546* (2013.01)

(58) Field of Classification Search
CPC ..... E05F 15/616; E05F 15/53; E05F 15/611; E05F 15/60; E05F 11/08; E05F 15/614; B62D 33/0273; E05Y 2900/546
USPC ..... 49/339, 340
See application file for complete search history.

(56) References Cited

U.S. PATENT DOCUMENTS 3,306,655 A * 2/1967 Voehringer ..... B60J 5/103 296/57.1
3,713,472 A 1/1973 Dozois
3,716,945 A 2/1973 Cooper et al.
6,181,094 B1 * 1/2001 Menke ..... E05F 1/1207 318/434
6,448,729 B1 * 9/2002 Davies ..... E05F 15/41 318/432
6,637,494 B1 * 10/2003 Nabeta ..... E05D 15/264 160/188
6,669,268 B2 * 12/2003 Oberheide ..... E05F 15/622 296/146.8
6,676,190 B2 1/2004 Daniels et al.
9,540,859 B2 1/2017 Hansen
9,822,574 B2 11/2017 Heiberger et al.
2001/0035661 A1 * 11/2001 Doshi ..... B60R 13/01 296/39.2
2003/0089041 A1 * 5/2003 Daniels ..... E05F 15/63 49/341

(Continued)

*Primary Examiner* — Gregory J Strimbu
(74) *Attorney, Agent, or Firm* — Christopher G. Darrow; Darrow Mustafa PC

(57) ABSTRACT

A tailgate control system for a vehicle includes a spindle and a coupling member fixedly coupled to a tailgate of the vehicle, the coupling member having a slot formed therein. A portion of the spindle is coupled to the coupling member via the slot so as to enable relative movement between the portion of the spindle and the coupling member along the slot, and such that extension of the spindle causes a force on the coupling member which causes a closing motion of the tailgate. The portion of the spindle is also coupled to the coupling member such that a manually-generated closing motion of the tailgate causes a change in a position of the portion of the spindle along the slot.

17 Claims, 8 Drawing Sheets

(56) References Cited

U.S. PATENT DOCUMENTS

| | | | | |
|---|---|---|---|---|
| 2010/0192942 | A1* | 8/2010 | Jones | F24S 30/458<br>126/602 |
| 2013/0145695 | A1* | 6/2013 | Wach | E05F 5/02<br>49/381 |
| 2019/0169907 | A1* | 6/2019 | Leonard | E05F 11/34 |
| 2020/0141171 | A1* | 5/2020 | Ghannam | E05F 15/43 |

* cited by examiner

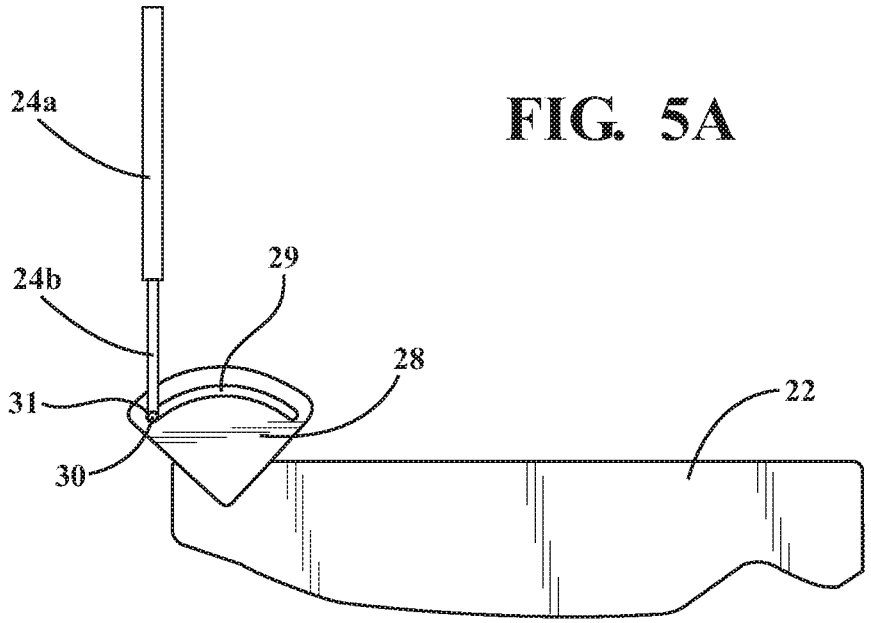
FIG. 5A
FIG. 5B
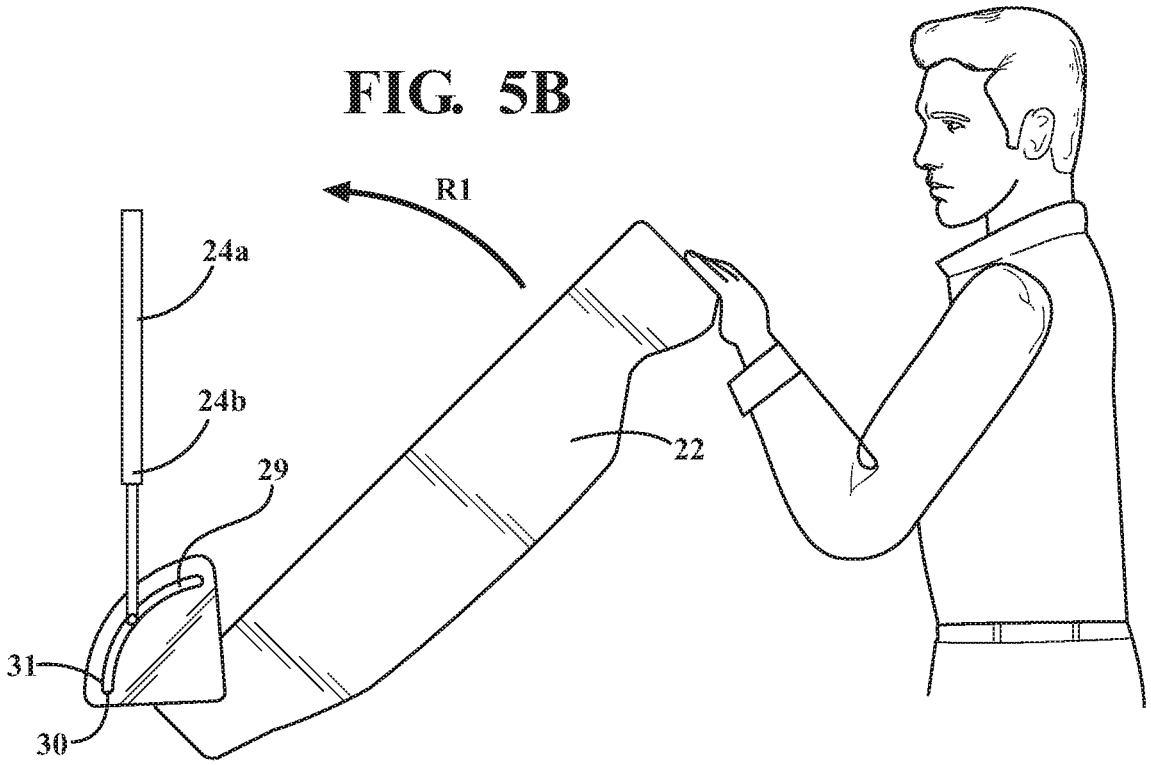

FIG. 5C
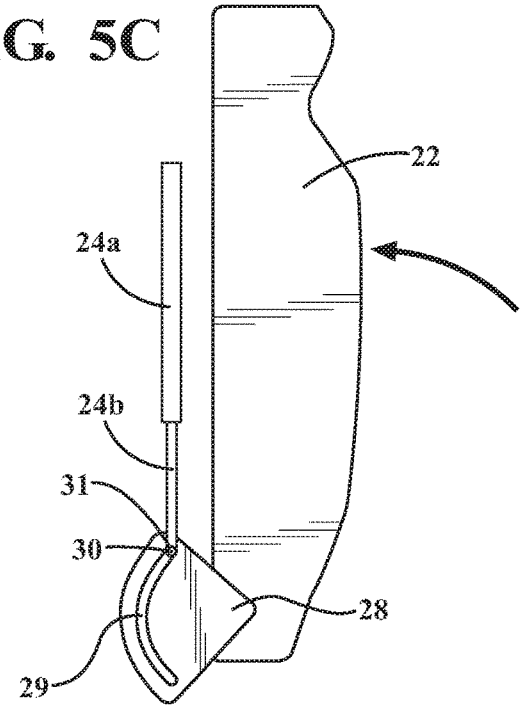
FIG. 5D
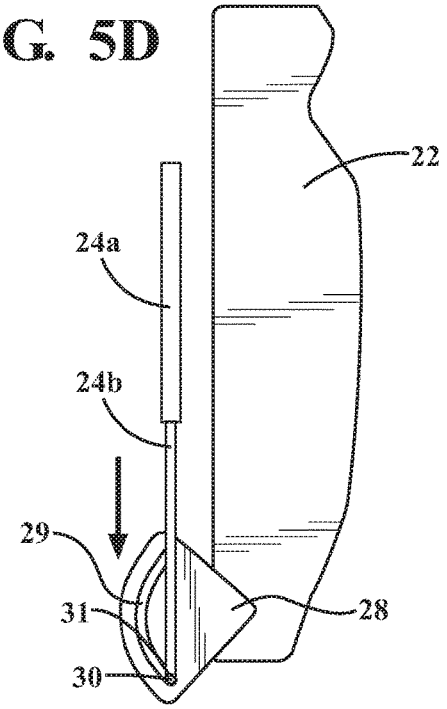
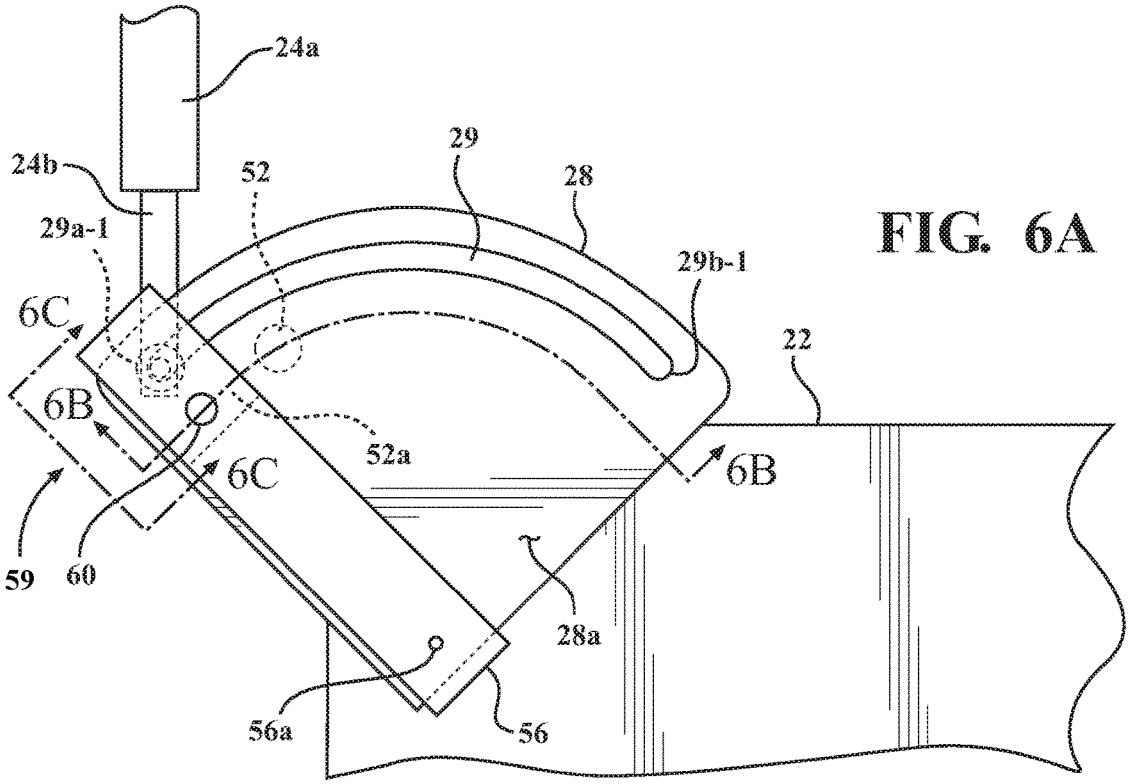
FIG. 6A

POWER TAILGATE HAVING MANUAL OPERATION FEATURE

TECHNICAL FIELD

The present invention relates to vehicle tailgates and, more particularly, to a vehicle tailgate which may be operable both manually and automatically.

BACKGROUND

Vehicles such as pickup trucks having tailgates may be operated to raise and lower the tailgate automatically and/or autonomously. Such vehicles may employ a spindle drive having a spindle which extends and retracts to lower and raise the tailgate. In many cases, vehicle users wish to manually close the tailgate. However, a powered tailgate typically cannot be disconnected from the spindle drive for manual closing of the tailgate. For manual operation of a tailgate connected to a spindle drive, it is necessary to "back drive" the spindle (i.e., to compress or retract the spindle and extend it by manually opening and closing of the door). Back driving a spindle creates substantial resistance to manual tailgate operation due to inertia resulting from spinning the spindle motor and gear train.

SUMMARY

In one aspect of the embodiments described herein, a tailgate control system for a vehicle is provided. The control system may include a spindle and a coupling member fixedly coupled to a tailgate of the vehicle, the coupling member having a slot formed therein. A portion of the spindle is coupled to the coupling member along the slot so as to enable relative movement between the portion of the spindle and the coupling member along the slot, and such that extension of the spindle causes a force on the coupling member which causes a closing motion of the tailgate. The portion of the spindle is also coupled to the coupling member such that a manually-generated closing motion of the tailgate causes a change in a position of the portion of the spindle along the slot, in a first direction along the slot.

BRIEF DESCRIPTION OF THE DRAWINGS

The accompanying drawings, which are incorporated in and constitute a part of this specification, illustrate embodiments described herein and together with the description serve to explain principles of embodiments described herein.

FIG. 5A is a schematic side view of the tailgate of FIG. 1 shown in a fully open position, prior to manual closing of the tailgate.

FIG. 5B is the schematic side view of the tailgate of FIG. 5A, showing a user manually lifting the tailgate to close the tailgate.

FIG. 5C is the schematic side view of the tailgate of FIGS. 5A and 5B, showing the tailgate in a fully raised or closed position after manual closing by a user and prior to extension of the spindle.

FIG. 5D is the schematic side view of the tailgate of FIG. 5C showing extension of the spindle to return the spindle to a position for subsequent automatic lowering of the tailgate.

FIG. 6A is a magnified schematic side view of a portion of a tailgate control system including a detent mechanism in accordance with an embodiment described herein, and showing the tailgate in a fully lowered condition.

DETAILED DESCRIPTION

Figure 1:
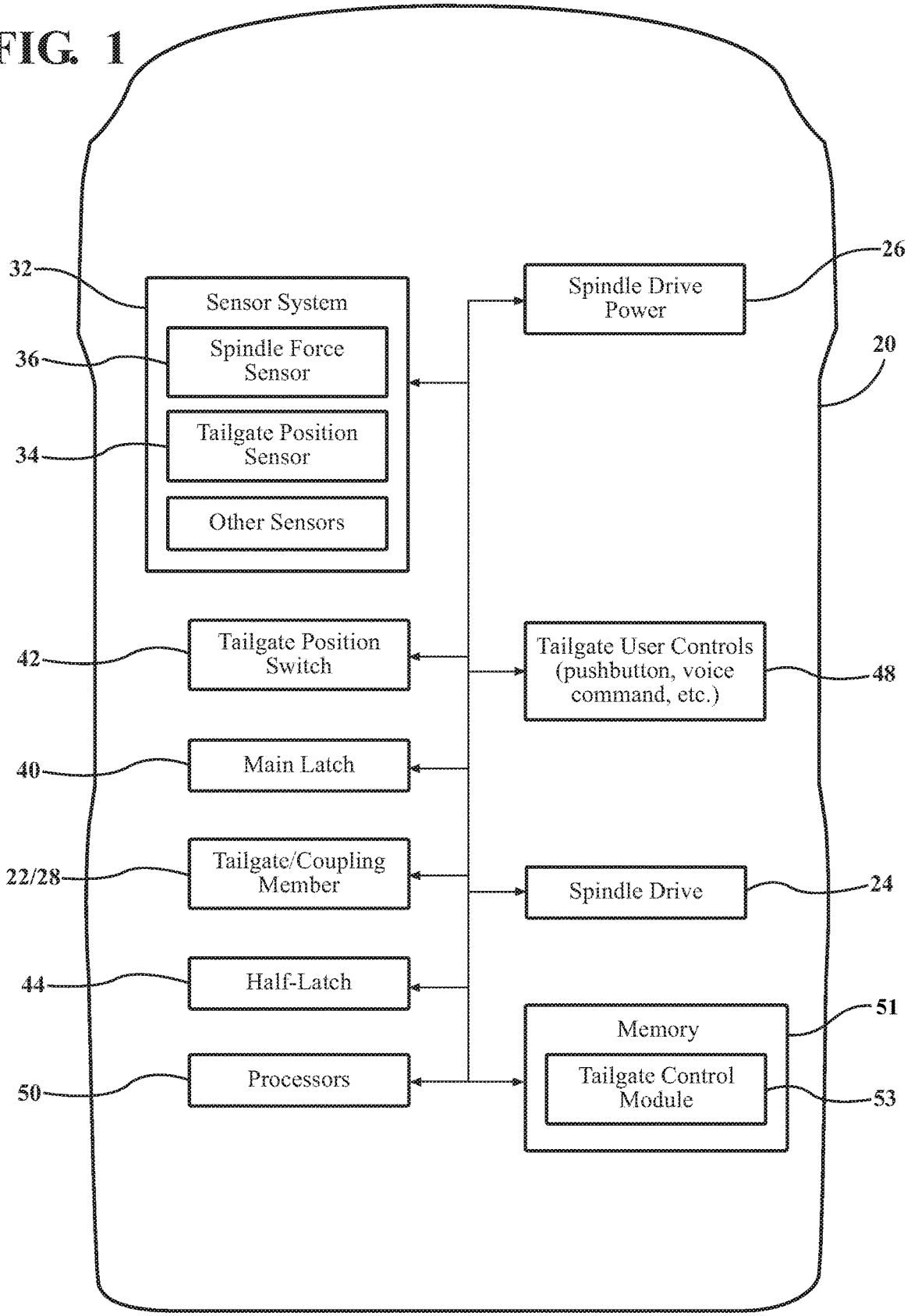
FIG. 1 is a schematic block diagram of a vehicle incorporating a tailgate control system in accordance with an embodiment described herein.

Embodiments described herein relate to a tailgate control system for a vehicle. The control system includes a spindle and a coupling member fixedly coupled to a tailgate of the vehicle. The coupling member has a slot formed therein. A portion of the spindle is coupled to the coupling member along the slot so as to enable relative movement between the portion of the spindle and the coupling member along the slot. The portion of the spindle exerts force on an edge of the slot to open and close the tailgate without physical contact between a user and the tailgate. Manual closing of the tailgate rotates the coupling member without rotating the spindle, thereby separating the portion of the spindle from the edge of the slot. The tailgate control system may be configured to automatically reposition the portion of the spindle to the edge of the slot responsive to manual lifting of the tailgate. This relocates the portion of the spindle so that it may exert the forces on the edge of the coupling member slot necessary for lowering and raising the tailgate without user contact. The tailgate control system may also include a detent mechanism structured to maintain the portion of the spindle in a predetermined location along the slot prior to generation of the manually-generated closing motion of the tailgate.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. Unless otherwise noted, similar reference characters are used to describe similar features on separate elements and/or embodiments.

FIG. 1 is a schematic block diagram of a vehicle 20 incorporating a tailgate control system for controlling operations related to raising and lowering of a tailgate 22 of the vehicle 20. The tailgate control system can have any combination of the various elements shown in FIG. 1. The tailgate control system may have more or fewer elements and/or systems than shown. The tailgate control system may also include alternative elements and/or systems to those shown. In some arrangements, the tailgate control system may be implemented without one or more of the elements shown in FIG. 1.

The vehicle 20 may be, for example, a pickup truck. However, although the elements and operation of the tailgate control system embodiments will be described herein as may be applicable to a pickup truck tailgate, it will be understood that an embodiment of the tailgate control system may be implemented in any vehicle having a tailgate which may be lifted and lowered to provide access to a cargo bed or interior of the vehicle.

Figure 2:
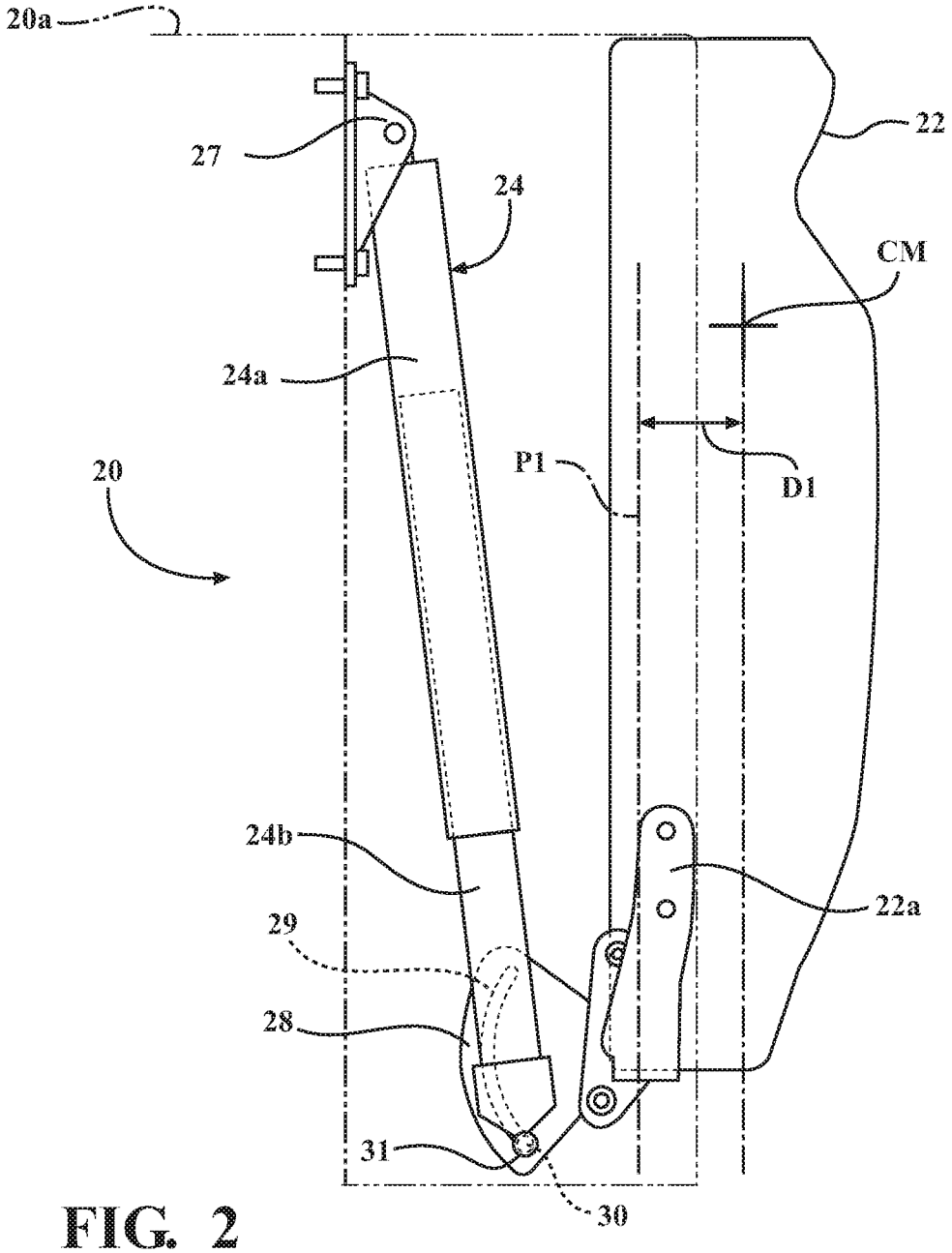
FIG. 2 is a schematic side view of a rear end of a pickup truck showing elements of a tailgate control system in accordance with an embodiment described herein.

FIG. 2 is a schematic side view of a rear end of a pickup truck 20 showing elements of a tailgate control system in accordance with an embodiment described herein. The tailgate control system may be configured for automatically lowering and raising the tailgate 22 responsive to a user-generated command (for example, a push button or voice command). Responsive to such a command, the tailgate 22 may be actuated (i.e., lowered and/or raised) by the control system without manual effort.

In addition, embodiments of the tailgate control system may be configured to enable a user to raise the tailgate 22 to a closed or partially-closed position by manually lifting the tailgate 22 to cause a manually-generated closing motion of the tailgate. FIG. 2 shows the tailgate 22 in a fully raised or closed position (i.e., a position in which the tailgate is vertical or near-vertical and is secured for vehicle travel by a vehicle lock or latch (not shown)). The tailgate may be rotatably supported by one or more hinges 22*a* at a suitable location proximate a rear of the truck bed. The tailgate 22 may be supported such that a center of mass CM of the tailgate is offset a distance D1 from a vertical plane P1 extending through the hinges/support locations 22*a* so as to impart to the tailgate 22 a tendency to drop backward into a lowered position absent a counter-force tending to maintain the tailgate 22 in a closed and latched condition.

Referring to FIGS. 1 and 2, the tailgate control system may include a spindle drive 24 structured to be operable to raise and lower the tailgate 22 in a manner described herein. As known in the art, the spindle drive 24 may include a housing 24*a* and a spindle 24*b* extending from the housing 24*a*. The spindle drive 24 may also include bearings (not shown) supporting the spindle 24*b*, a motor (not shown), gears (not shown) and other components operable to extend the spindle 24*b* from the housing 24*a* and retract the spindle into the housing responsive to suitable control commands. A power source 26 for the spindle drive 24 may be a vehicle battery or by any other suitable vehicular power source.

In the manner described herein, the tailgate control system may be structured so that extension of the spindle 24*b* from housing 24*a* raises the tailgate 22, and retraction of the spindle 24*b* into housing 24*a* lowers the tailgate 22 under the force exerted by the weight of the tailgate. "Extension" of the spindle 24*b* or "extending" the spindle refers to movement of the spindle 24*b* in a direction out of the spindle drive housing 24*a*, thereby causing an increase in the overall length of the spindle drive 24. Conversely, "retraction" of the spindle 24*b* refers to movement of the spindle in a direction into the housing 24*a*, thereby causing a decrease in the overall length of the spindle drive 24.

The spindle drive housing 24*a* may be secured to a portion of the vehicle which is static (i.e., non-moving during operation of the spindle drive 24). For example, the spindle drive housing 24*a* may be secured to a sidewall 20*a* of the truck 20. The spindle drive housing 24*a* may be connected to a rear portion of the sidewall 20*a* using a ball joint 27, thereby permitting a degree of rotation of the spindle drive housing 24*a* with respect to the rear portion of the truck 20.

Figure 3:
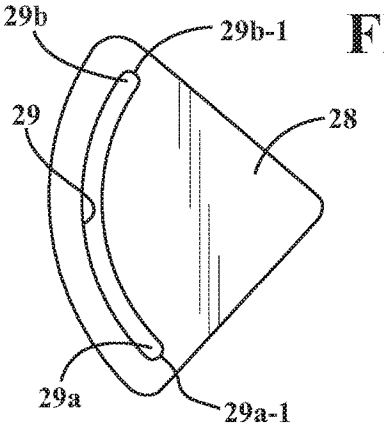
FIG. 3 is a schematic side view of a tailgate/spindle coupling member in accordance with an embodiment described herein.

Referring to FIGS. 2 and 3, the spindle 24*b* may be operably coupled to a coupling member 28. The coupling member 28 may be fixedly coupled to the tailgate 22. "Fixedly coupled" refers to the coupling member 28 being directly or indirectly attached to the tailgate 22 so that the tailgate and the coupling member rotate together, effectively as a single object. In one or more arrangements, the coupling member 28 may be in the form of a flat plate fabricated from steel or any other suitable material.

The coupling member may have a curved slot 29 formed therein. Coupling member slot 29 may have a first end 29*a* and a second end 29*b* opposite the first end. First end 29*a* may include a first edge 29*a*-1 of the slot 29 and second end 29*b* may include a second edge 29*b*-1 of the slot.

A portion (such as an end portion) of the spindle 24*b* may be coupled to the coupling member 28 along the slot 29 so as to enable relative movement between the portion of the spindle and the coupling member 28 along the slot 29, during operation of the tailgate control system. "Relative movement" between the portion of the spindle and the coupling member 28 may refer to movement of the portion of the spindle with respect to the coupling member 28 when the coupling member 28 is static with respect to a fixed frame of reference (for example, a ground surface on which the vehicle 20 resides). "Relative movement" between the portion of the spindle and the coupling member 28 may also refer to movement of the coupling member 28 with respect to the portion of the spindle when the portion of the spindle is static with respect to the fixed frame of reference. "Relative movement" between the portion of the spindle and the coupling member 28 may also refer to simultaneous movement of both the coupling member 28 and the portion of the spindle with respect to each other. Thus, movement of the portion of the spindle connected to the coupling member 28 along the slot 29 may be constrained by the geometry of the slot 29 (i.e., the portion of the spindle movably coupled to the slot 29 may be restricted to movement in directions along the slot).

For example, a projection 30 may extend in a direction from the spindle 24*b* toward the coupling member 28 and into the slot 29. The projection 30 may be secured in the slot 29 in a manner permitting slidable movement of the projection 30 along the slot 29 during operation of the tailgate control system. In one or more arrangements, the projection 30 may be coupled to the spindle 24*b* by a ball joint 31, to permit a degree of rotation of the projection 30 with respect to the spindle 24*b*.

Referring again to FIG. 1, the vehicle 20 can include a sensor system 32. The sensor system 32 can include one or more sensors. "Sensor" means any device, component and/or system that can detect, and/or sense something. The one or more sensors can be configured to detect, and/or sense in real-time. As used herein, the term "real-time" means a level of processing responsiveness that system senses as sufficiently immediate for a particular process or determination to be made, or that enables the processor to keep up with some external process. Sensors other than those shown in FIG. 1 may be incorporated into the sensor system 32.

In arrangements in which the sensor system 32 includes a plurality of sensors, the sensors can function independently from each other. Alternatively, two or more of the sensors can work in combination with each other. In such a case, the two or more sensors can form a sensor network. The sensor system 32 and/or the one or more sensors can be operably connected to the processor(s) 50 (described below), tailgate control module 53 (also described below) and/or another element of the vehicle 20 (including any of the elements shown in FIG. 1). The sensor system 32 can include any suitable type of sensor. Various examples of different types of sensors may be described herein. However, it will be understood that the embodiments are not limited to the particular sensors described.

In one or more arrangements, the sensor system 32 may include at least one tailgate position sensor 34. The tailgate position sensor 34 may be configured to detect a rotational position of the tailgate 22. The rotational position of the tailgate 22 may be any angular orientation of the tailgate between (and including) the fully open position shown in FIG. 4C and the fully closed position shown in FIGS. 2 and 4A. In arrangements of the tailgate control system including a tailgate position sensor 34, the spindle 24*b* may be controlled so as to extend as described herein responsive to detection of the tailgate 22 in a predetermined rotational position.

In one or more arrangements, the sensor system 32 may include at least one spindle force sensor 36 operably coupled to the spindle drive 24 and to a tailgate control module 53 as described herein. The force sensor(s) 36 may be configured to detect a reaction force acting on the spindle 24*b* due to contact with slot first edge 29*a*-1 of coupling member 28 as described herein. Responsive to a magnitude of the reaction force, the spindle 24*b* may be operated to continue extending (or attempting to extend) the spindle 24*b* or to discontinue further extension of the spindle as described in greater detail below.

A main latch 40 may be provided to maintain the tailgate 22 in the fully-raised position. Components of the main latch 40 may be installed in location(s) on the truck 20 and/or tailgate 22 such that the main latch 40 actuates automatically to latch the tailgate when the tailgate 22 reaches the fully closed position. The main latch 40 may be configured to be automatically releasable by a signal from the tailgate control module 53 (described in greater detail below) during an automatic lowering procedure of the tailgate 22. In one or more arrangements, the main latch 40 may also be configured to be manually releasable.

In one or more arrangements, the positioning of the tailgate 22 in the fully raised position may be detected by tailgate position sensor 34 as described herein. Responsive to detection of the tailgate 22 in the fully-raised position by the sensor 34, the main latch 40 may be automatically activated to ensure that the tailgate 22 is maintained in the fully-raised position until the main latch 40 is released or disengaged.

Referring again to FIG. 1, in one or more arrangements, a tailgate position switch 42 may be mounted on the tailgate 22 and/or on a rear wall of the cargo bed. The tailgate position switch 42 may be configured to actuate (i.e., open or close) when the tailgate 22 reaches a predetermined position during a manual or automatic closing motion of the tailgate 22. Actuation of the tailgate position switch 42 may result in a signal being transmitted to the tailgate control module 53 indicating that the tailgate 22 has reached the predetermined position during automated closing by retraction of the spindle 24*b* or manual lifting by the user. The tailgate control module 53 may then cause the spindle 24*b* to extend, to move the portion of the spindle 24*b* coupled to the coupling member slot 29 along the slot toward the slot first edge 29*a*-1, as described in greater detail below.

Figure 4B:
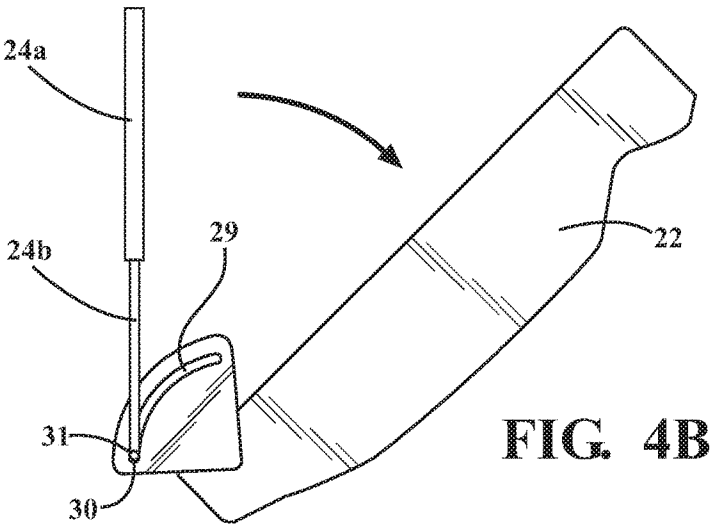
FIG. 4B is the schematic view of FIG. 4A showing the tailgate automatically opening responsive to an "open" command.

In one or more arrangements, the tailgate position switch 42 may be configured to actuate when the tailgate 22 reaches a "half-latch" position during the manual closing motion of the tailgate. The "half-latch" position (an example of which is shown in FIG. 4B) may be a predetermined position or angular orientation of the tailgate 22 at which an intermediate latch (or "half-latch") 44 engages to prevent the tailgate 22 from falling back to the open position if the tailgate 22 is released by the user. Components of "half-latch" 44 may be installed in location(s) on the truck 20 such that the "half-latch" actuates automatically during a closing motion (either manual or automatic) of the tailgate 22 when the tailgate reaches a predetermined "half-latch" position. The "half-latch" 44 may be configured to be automatically releasable by a signal from the tailgate control module 53 (described in greater detail below) during automatic lowering of the tailgate 22. In one or more arrangements, the "half-latch" 44 may also be configured to be manually releasable.

In one or more arrangements, the positioning of the tailgate 22 in the "half-latch" position may be detected by a tailgate position sensor 34 as described herein. Responsive to detection of the tailgate 22 in the "half-latch" position by the sensor 34, the "half-latch" 44 may be automatically activated to ensure that the tailgate 22 does not fall below the "half-latched" position if the motive force acting on the tailgate is removed.

One or more tailgate user controls 48 may be operably coupled to the tailgate control system. The tailgate user controls 48 may be configured to enable a user to control raising and/or lowering of the tailgate 22. In one or more arrangements, the user controls 48 may comprise a push-button, touch screen option, voice/speech recognition interface, or any other control interface configured to enable a user to command the tailgate control system to raise and/or lower the tailgate 22.

Referring again to FIG. 1, the vehicle can include one or more processors 50. In one or more arrangements, the processor(s) 50 can be a main processor of the vehicle 20. For instance, the processor(s) 50 can be an electronic control unit (ECU). The processor(s) 50 may be operably connected to other elements of the vehicle as well as the tailgate control system for receiving information from the other elements and for issuing control commands to the other elements, to control or aid in controlling operations of the vehicle. The terms "operably connected" and "operably coupled" as used throughout this description, can include direct or indirect connections, including connections without direct physical contact.

One or more memories 51 may be operably coupled to the processor(s) 50 for storing a tailgate control module 53 (described below), other modules, and any data and other information needed for diagnostics, operation, control, etc. of the vehicle 20. The memory(s) 51 may be one or more of a random-access memory (RAM), read-only memory (ROM), a hard-disk drive, a flash memory, or other suitable memory for storing the required modules and information.

Some operations of the tailgate 22 may be autonomously controlled, for example, by the tailgate control module 53. As used herein, "autonomous control" refers to controlling various aspects of the movement and/or other operations of the tailgate with minimal or no input from a human operator. Minimal input from a human operator may include, for example, pushing a button, touching a touch screen, or issuing a voice command directing one or more vehicle systems and/or elements to raise or lower the tailgate. Generally, "module", as used herein, includes routines, programs, objects, components, data structures, and so on that perform particular tasks or implement particular data types. In further aspects, a memory generally stores the noted modules. The memory associated with a module may be a buffer or cache embedded within a processor, a RAM, a ROM, a flash memory, or another suitable electronic storage medium, such as memory(s) 51. In still further aspects, a module as envisioned by the present disclosure is implemented as an application-specific integrated circuit (ASIC), a hardware component of a system on a chip (SoC), as a programmable logic array (PLA), or as another suitable hardware component that is embedded with a defined configuration set (e.g., instructions) for performing the disclosed functions.

In addition to the tailgate control module 53, one or more other modules (not shown) for other purposes may be incorporated into the vehicle. Any of the modules can be implemented as computer-readable program code that, when executed by processor(s) 50, autonomously implement various vehicle control functions. Such functions may include control of the spindle drive 24 as described herein. One or more of the modules can be a component of the processor(s) 50, or one or more of the modules can be executed on and/or distributed among other processing systems to which the processor(s) 50 is operably connected. The modules can include instructions (e.g., program logic) executable by the one or more processor(s) 50. In one or more arrangements, one or more of the vehicle modules can include artificial or computational intelligence elements, e.g., neural network, fuzzy logic or other machine learning algorithms. Further, in one or more arrangements, the functions of one or more of the modules can be distributed among a plurality of the modules described herein. In one or more arrangements, two or more of the modules can be combined into a single module.

The tailgate control module 53 and/or processor(s) 50 can be configured to receive data from the sensor system 32 and/or any other type of system or element capable of acquiring information relating to the tailgate 22. In one or more arrangements, the tailgate control module 53 and/or processor(s) 50 can use such data in controlling raising and lowering of the tailgate. Information acquired by the tailgate control module 53 may be used to determine or estimate the current state of the tailgate 22 (i.e., whether the tailgate is fully open, fully closed, partially open/closed, the current angular orientation or position of the tailgate with respect to a reference frame (for example, the cargo bed floor), etc.). The tailgate 22 is "fully open" when the tailgate is lowered to the maximum degree contemplated by the tailgate design (usually to a horizontal orientation or position in which the tailgate may be supported by a shelf or other portion of the vehicle).

The tailgate control module 53 can control various operations of the tailgate either alone or in combination with processor(s) 50. The tailgate control module 53 can be configured cause the tailgate to, directly or indirectly, completely close, completely open, partially close, or partially open responsive to manually-generated commands, sensor readings and/or other stimuli. The tailgate control module 53 can be configured control the spindle drive 24 to cause the spindle **24*b*** to extend and retract. As used herein, "cause" or "causing" means to make, command, instruct, and/or enable an event or action to occur or at least be in a state where such event or action may occur, either in a direct or indirect manner.

The tailgate control module 53 may include instructions that when executed by the one or more processors 50 cause the one or more processors to control operation of the spindle **24*b* to extend and/or retract the spindle from or into the spindle housing, responsive to various user-generated or autonomous commands. The tailgate control module 53 may include instructions that when executed by the one or more processors 50 cause the one or more processors to control operation of the main latch and/or the half-latch to release or disengage any latch(es) responsive to a user command to lower the tailgate. The tailgate control module 53 may include instructions that when executed by the one or more processors 50 cause the one or more processors to control actuation of the main latch 40 and/or the half-latch 44 to restrict a backward motion of the tailgate 22**, responsive to a detected position or orientation of the tailgate during raising of the tailgate.

The tailgate control module 53 may include instructions that when executed by the one or more processors 50 cause the one or more processors to control operation of the spindle **24*b* to extend the spindle responsive to actuation of at least one switch (for example, tailgate position switch 42) to restrict a backward motion of the tailgate 22. Actuation of the switch may indicate that the tailgate 22 has reached a predetermined orientation or position where it is desirable to control the spindle so as to extend the spindle 24*b*. The tailgate control module 53 may include instructions that when executed by the one or more processors 50 cause the one or more processors to control operation of the spindle 24*b* to extend the spindle responsive to detection of the tailgate 22 in a predetermined rotational position. The tailgate control module 53 may include instructions that when executed by the one or more processors 50 cause the one or more processors to control operation of the spindle 24*b* to extend the spindle so that the portion of the spindle coupled to the coupling member 28 contacts the first edge 29*a*-1 of the coupling member slot 29**.

The tailgate control module 53 may include instructions that when executed by the one or more processors 50 cause the one or more processors to control operation of the spindle **24*b* to halt further attempted extension of the spindle responsive to a reaction force in the spindle reaching a predetermined level, responsive to contact between the projection 30 and the coupling member slot first edge 29*a*-1 after moving the projection 30 along the slot 29 toward the first end 29*a* of the slot. The tailgate control module 53 may include instructions that when executed by the one or more processors 50 cause the one or more processors to control operation of the spindle 24*b* to extend the spindle so that the portion of the spindle coupled to the coupling member 28 exerts a force on the first edge 29*a*-1 of the slot 29 sufficient to generate a closing motion of the tailgate 22** by action of the spindle alone.

Generally, the tailgate control module 53 can be configured to execute various tailgate control functions and/or to transmit data to, receive data from, interact with, and/or control the tailgate and/or one or more related elements and/or systems.

Figure 4C:
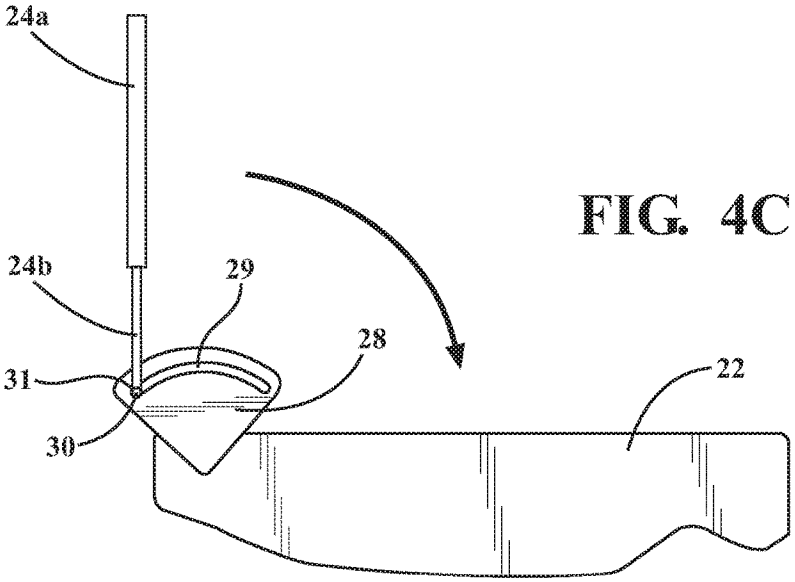
FIG. 4C is the schematic side view of the tailgate of FIGS. 4A and 4B, shown in a fully open or lowered position.
Figure 4A:
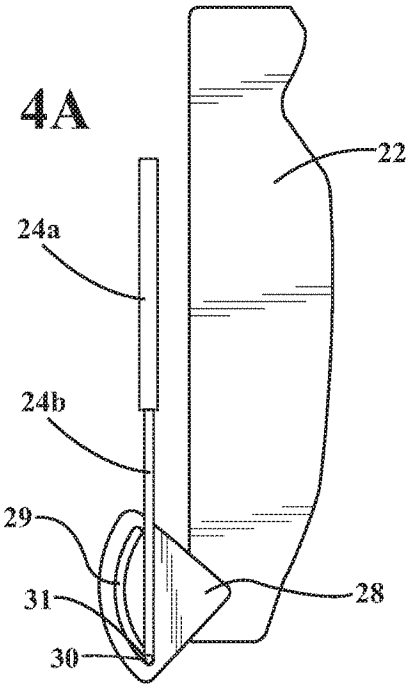
FIG. 4A is a schematic side view of the tailgate of FIG. 1 in a closed or fully-raised position.

FIGS. 4A-4C are schematic side views of the tailgate shown in FIG. 2. FIGS. 4A-4C show operation of the tailgate control system to automatically open and close the tailgate responsive to a command from a user. As previously described, the tailgate 22 may be supported at the rear end of the truck 20 by one or more hinges 22*a*. The tailgate 22 may be maintained in the closed or fully-raised condition shown by main latch 40 and/or by a force applied by the spindle 24*b* to the tailgate 22 through the coupling member 24 as described herein. As seen in FIG. 4A, when the tailgate 22 is fully-raised, spindle 24*b* is in an extended condition and the projection 30 coupled to the spindle 24*b* exerts a force on the coupling member slot first edge 29*a*-1. This effectively maintains the attached tailgate 22 in a fully-raised or closed condition absent a latching force by main latch 40 to secure the tailgate.

Referring to FIG. 4B, when it is desired to automatically open the tailgate 22, an "open" command may be issued by a user. This may release the main latch 40 securing the tailgate 22 in the closed or fully-raised position. The force exerted by the spindle 24*b* on the coupling member slot first edge 29*a*-1 then prevents the tailgate 22 from dropping. Responsive to the "open" command, the spindle 24*b* is gradually retracted into housing 24*a* while maintaining the force on the coupling member slot first edge 29*a*-1. This causes an opening motion of the tailgate 22, allowing the tailgate 22 to drop gradually backward into the fully open position shown in FIG. 4C. An "opening motion" of the tailgate 22 is defined as a movement of the tailgate 22 in a direction toward a fully open condition of the tailgate. The tailgate 22 may be supported in the open position by a shelf or hard stop (not shown) located so as to halt rotation of the tailgate in a desired orientation. Alternatively, the tailgate 22 may be supported in the open position by a pair of cables (not shown), with a cable extending from a portion of the rear wall of the cargo bed along each side of the rear cargo bed opening.

To automatically close the tailgate 22, the opening procedure just described may be reversed. Starting in FIG. 4C, a "close" command may be issued by a user using the tailgate user controls 48. Responsive to the "close" command, the spindle 24*b* may be gradually extended from housing 24*a* to increase the force acting on the coupling member slot first edge 29*a*-1. This forces the coupling member 28 to rotate, thereby rotating the tailgate 22 to cause a closing motion of the tailgate 22. A "closing motion" of the tailgate 22 is defined as a movement of the tailgate in a direction toward a fully closed condition of the tailgate. The spindle 24*b* may continue to extend until the tailgate 22 is rotated to the fully raised condition shown in FIG. 4C, in which a latching mechanism may be engaged to hold the tailgate in the raised or closed position.

FIGS. 5A-5D illustrate a first operational mode of the tailgate control system responsive to manual closing of the tailgate 22. Referring to FIGS. 5A-5D, when the tailgate is open, a user may apply a manual force to close the tailgate 22, thereby inducing a "manually-generated" closing motion of the tailgate. A "manually-generated" closing motion of the tailgate 22 is a motion of the tailgate in a direction toward the fully closed condition, where the motion is generated wholly by a user without any assistance from the spindle drive 24 or any other tailgate actuation mechanism.

In FIG. 5A, the tailgate 22 is shown in a fully-lowered position. However, the manual closing mode may also be implemented when the tailgate 22 is only partially open. The tailgate 22 is in this position following a command to the tailgate control system to automatically lower the tailgate 22 by retracting the spindle 24*b*, as previously described. Thus, when the tailgate 22 is fully lowered as in FIG. 5A, the spindle 24*b* is retracted.

In FIG. 5B, a user may lift the tailgate 22 so as to cause a manually-generated closing motion of the tailgate. Since the coupling member 28 is fixedly attached to the tailgate, lifting and rotation of the tailgate 22 causes an associated rotation of the coupling member 28. Since the tailgate closing motion is manually-generated, the spindle 24*b* remains retracted. As the coupling member 28 rotates, the coupling member slot 29 moves with respect to the projection 30 extending into the slot, so that the projection 30 effectively moves along the slot 29 in a direction from slot first edge 29*a*-1 toward slot second edge 29*b*-1 (see FIG. 3).

The manually-generated closing motion of the tailgate 22 and the motion of the projection 30 in coupling member slot 29 continue until the tailgate 22 is fully closed (FIG. 5C). However, in order for the tailgate 22 to be subsequently lowered automatically, the spindle 24*b* must be extended so as to exert a bearing force on coupling member slot first edge 29*a*-1. The tailgate control module 53 may determine (from the output of a suitable sensor or switch) that the tailgate 22 is in a fully closed position, and that the spindle 24*b* is still retracted. When the tailgate 22 is determined to be fully closed, the tailgate control module 53 may control operation of the spindle 24*b* to extend the spindle (FIG. 5D). This causes the projection 30 to move along the slot 29 in a direction from slot second edge 29*b*-1 toward slot first edge 29*a*-1.

When the projection 30 reaches and contacts slot first edge 29*a*-1, the tailgate control module 53 may control operation of the spindle 24*b* to halt extension of the spindle. In one or more arrangements, extension of the spindle 24*b* may be halted when the spindle is determined to exert a threshold minimum bearing force on slot first edge 29*a*-1. This force may be a force sufficient to prevent the tailgate 22 from falling into an open position after release of the main latch 40 holding the tailgate 22 closed, and to permit a controlled lowering of the tailgate 22 by retracting the spindle 24*b* as previously described. A suitable force sensor (such as spindle force sensor 36) may be operably coupled to the tailgate control module 53 and configured to detect a reaction force acting on the spindle 24*b* due contact with slot first edge 29*a*-1 and exertion of the bearing force. The spindle 24*b* is now prepared to lower the tailgate 22 responsive to the next "lower tailgate" command.

In a particular operational mode, the tailgate control module 53 may control operation of the spindle 24*b* to start extending the spindle 24*b* when the tailgate is determined to be in the half-latch position (shown in FIG. 5B). The tailgate control module 53 may determine (from the output of a suitable sensor or switch) that the tailgate 22 is in the half-latch position. When the tailgate 22 is determined to be in the half-latch position, the tailgate control module 53 may control operation of the spindle 24*b* to start to extend the spindle. This causes the projection 30 to move along the slot 29 in the direction from slot second edge 29*b*-1 toward slot first edge 29*a*-1. When the projection 30 reaches and contacts slot first edge 29*a*-1, the tailgate control module 53 may control operation of the spindle 24*b* to halt extension of the spindle in the manner previously described.

Referring now to FIGS. 6A-7B, in one or more arrangements, the tailgate control system may include a detent mechanism (generally designated 59) structured to maintain the end of spindle 24*b* in a predetermined location along the coupling member slot 29 prior to generation of the manually-generated closing motion of the tailgate 22. The detent mechanism 59 may be structured to aid in maintaining engagement between the projection 30/spindle 24*b* and the coupling member 28 during operation of the tailgate control system.

In one or more arrangements, the detent mechanism 59 may include a protrusion 52 extending from a first side 28*a* of the coupling member 28. A link 56 may be coupled to the spindle 24*b* so that the coupling member is movable with respect to the link. In one or more arrangements, the link 56 may be rotatably coupled to the coupling member 28 at a common hinge 56*a* so that the coupling member 28 is rotatable with respect to the link 56. The link 56 may be secured at the hinge 56*a* at one end of the link and secured to the projection 30/spindle 24*b* at an opposite end of the link. In one or more arrangements, the projection 30 may extend through a hole formed in the link 56, then into the coupling member slot 29. A spring-loaded plunger 60 may be supported by the link 56 and may be structured to exert a bearing force on the first side 28*a* of the coupling member along a first side 52*a* of the protrusion 52. The spring-loaded plunger 60 may be structured to resiliently deflect responsive to contact between the plunger and the protrusion 52 during the manually-generated closing motion of the tailgate 22.

The protrusion 52 may be formed by any suitable method, for example, by pressing an indentation into a second side 28*b* of the coupling member opposite the first side 28*a*. Radii or ramps may be formed at the base of the protrusion 52 to provide a smooth blend or transition between a flat surface of the first side 28*a* adjacent the protrusion 52 and the protrusion itself. This enables smooth operation of the detent mechanism 59. The geometry of the protrusion 52 and transition regions may be tailored to aid in tuning the manual force needed to move the spring loaded plunger 60 past the protrusion 52 to produce a manually-generated closing motion of the tailgate 22 as described herein.

Figure 6B:
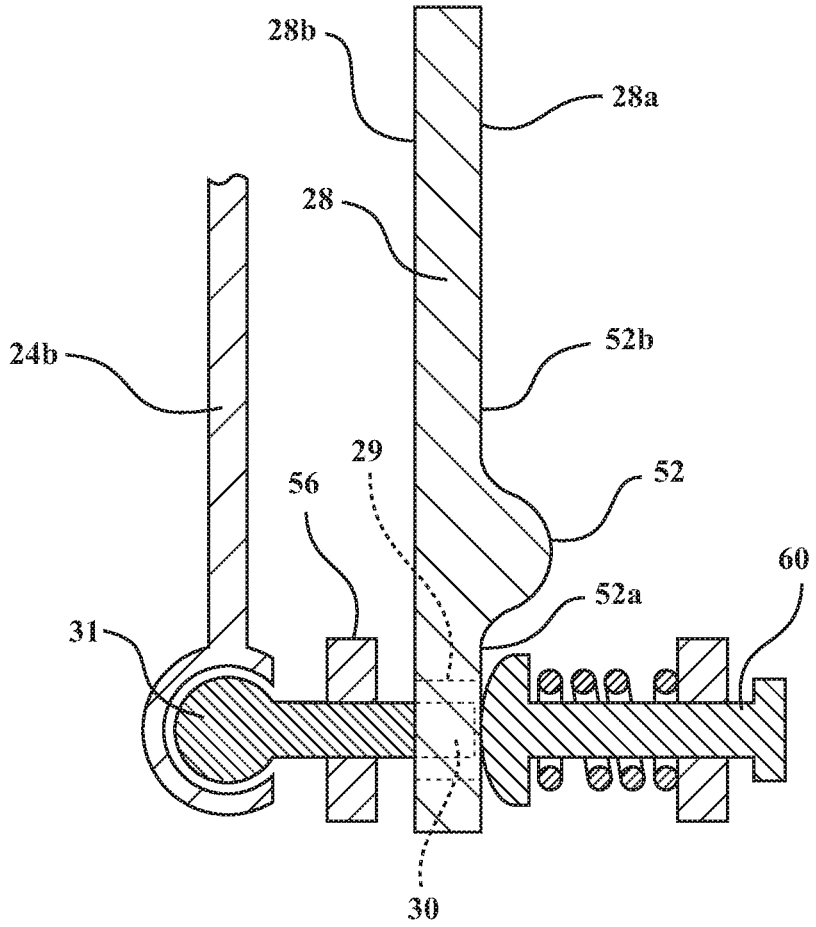
FIG. 6B is a schematic partial cross-sectional view of a portion of the tailgate control system and detent mechanism shown in FIG. 6A.
Figure 6C:
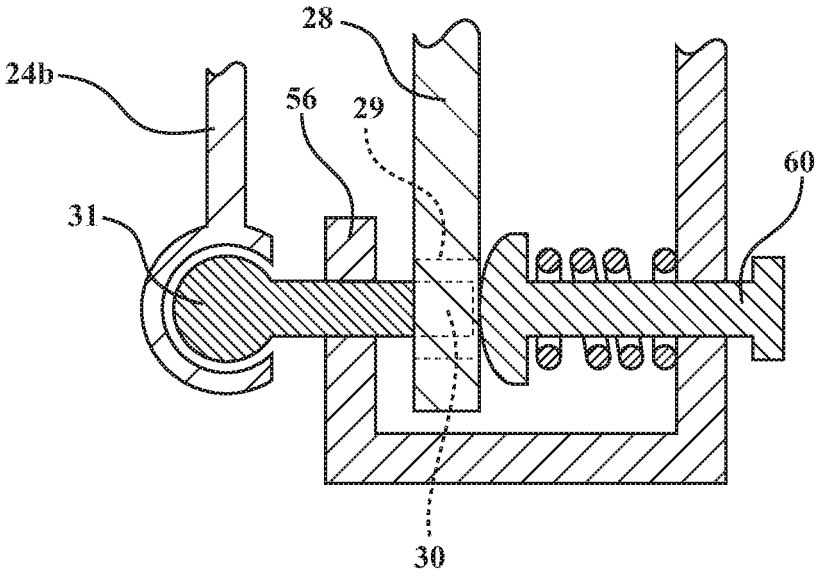
FIG. 6C is another schematic partial cross-sectional view of a portion of the tailgate control system and detent mechanism shown in FIG. 6A.
Figure 6D:
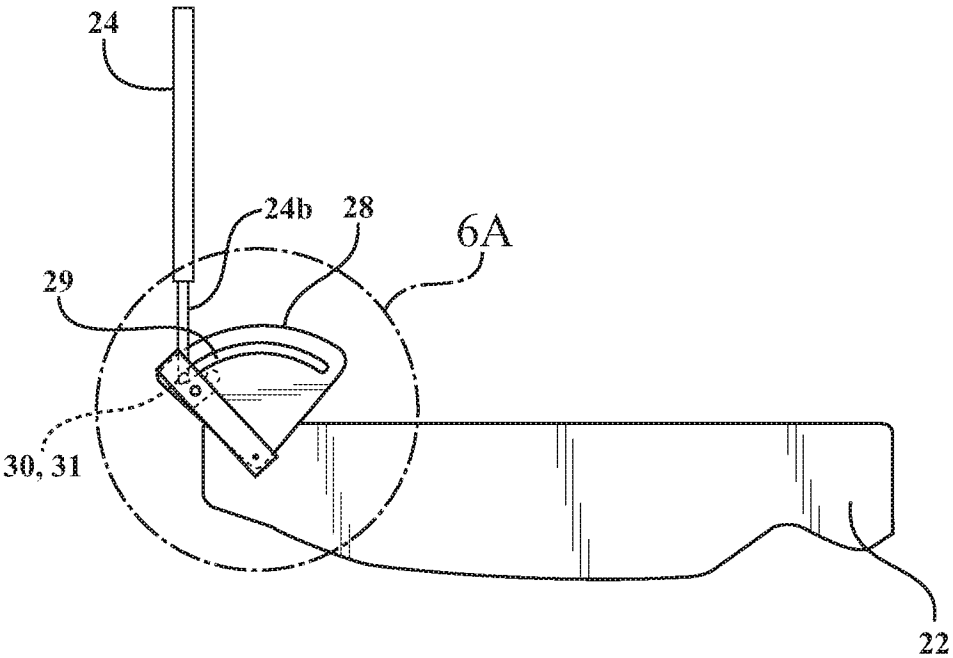
FIG. 6D is a schematic side view of the tailgate and tailgate control system shown in FIG. 6A, showing the tailgate in a fully lowered condition.
Figure 7A:
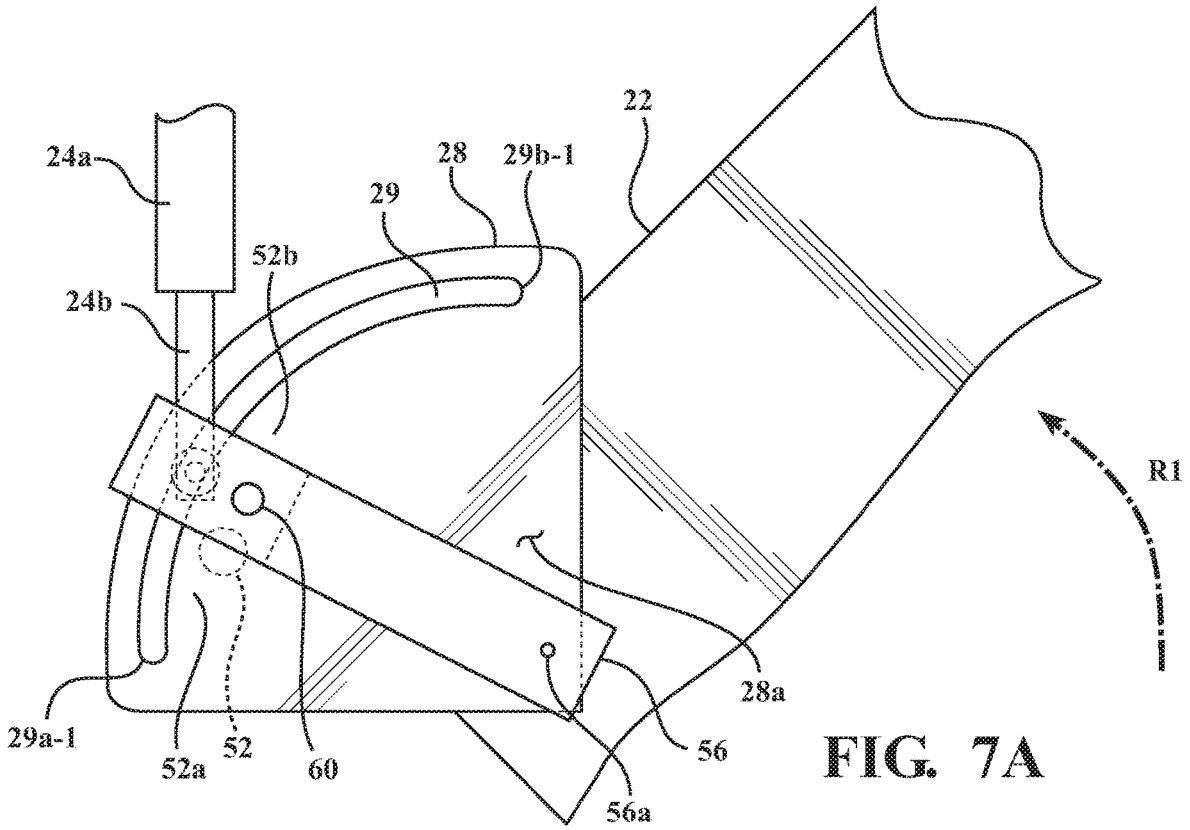
FIG. 7A is the schematic side view of FIG. 6A showing operation of the detent mechanism during manual closing of the tailgate.
Figure 7B:
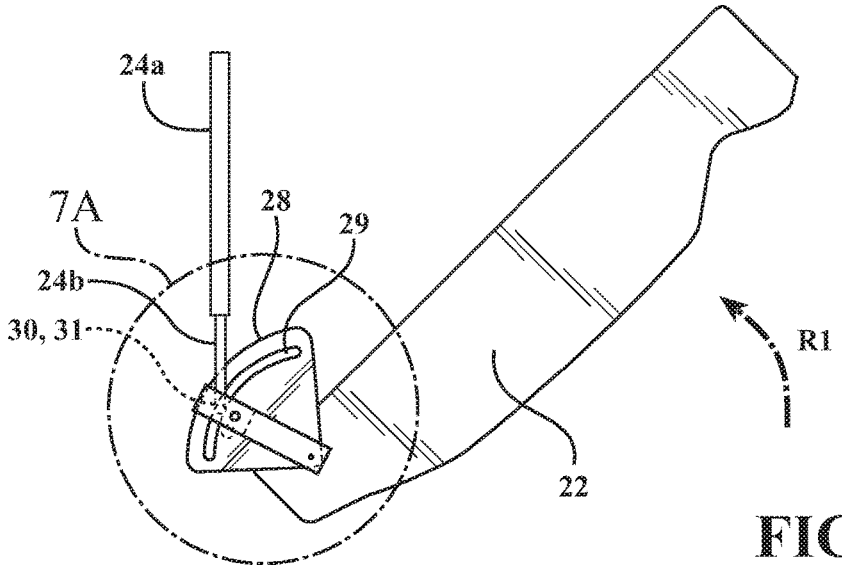
FIG. 7B is the schematic side view of FIG. 6D showing operation of the detent mechanism during manual closing of the tailgate.

In operation, with the tailgate 22 fully open as shown in FIG. 6D, the detent mechanism 59 is in the state shown in FIGS. 6A-6C. Referring to FIGS. 7A-7B, when it is desired to close the tailgate 22 manually, a user may exert a force on the tailgate in the closing direction R1. As the tailgate 22 begins to rotate in closing direction R1, the plunger 60 must move along the coupling member 28 and up and over protrusion 52, from the first side 52*a* of the protrusion to a second side 52*b* of the protrusion. The detent mechanism 59 is designed to require a relatively high, manually-generated impulse force to overcome the obstruction to plunger deflection provided by the protrusion 52. After the plunger 60 passes the protrusion 52, the user may continue manual lifting of the tailgate 22 until the tailgate reaches the half-latch position or the fully-raised position as previously described.

In the above detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g. AB, AC, BC or ABC).

Aspects herein can be embodied in other forms without departing from the spirit or essential attributes thereof. Accordingly, reference should be made to the following claims, rather than to the foregoing specification, as indicating the scope of the invention.

What is claimed is:

1. A tailgate control system for a vehicle, the control system comprising:

a spindle drive including a housing and a spindle structured to be extendible from and retractable into the housing;

a coupling member fixedly coupled to a tailgate of the vehicle, the coupling member having a slot formed therein, a portion of the spindle being coupled to the coupling member via the slot so as to enable relative movement between the portion of the spindle and the coupling member along the slot, and such that a manually-generated closing motion of the tailgate causes a change in a position of the portion of the spindle along the slot; and a detent mechanism structured to maintain the portion of the spindle in a predetermined location along the slot prior to generation of the manually-generated closing motion of the tailgate, wherein the detent mechanism comprises:

a protrusion extending from a side of the coupling member;

a link coupled to the portion of the spindle so that the coupling member is movable with respect to the link; and a spring-loaded plunger supported by the link and structured to exert a bearing force on the side of the coupling member along a side of the protrusion, and structured to resiliently deflect responsive to contact between the plunger and the protrusion during the manually-generated closing motion of the tailgate.

2. The tailgate control system of claim 1 wherein the portion of the spindle is coupled to the coupling member so as to enable exertion of a force by the portion of the spindle on an edge of the slot during extension of the spindle from the housing sufficient to cause a powered closing motion of the tailgate.

3. The tailgate control system of claim 1 wherein the portion of the spindle is coupled to the coupling member so as to enable exertion of a force by the portion of the spindle on an edge of the slot during retraction of the spindle into the housing sufficient to enable rotation of the tailgate toward a fully open condition in response to a weight of the tailgate.

4. The tailgate control system of claim 1 wherein the portion of the spindle is coupled to the coupling member using a ball joint.

5. The tailgate control system of claim 1 further comprising:

one or more processors; and a memory communicably coupled to the one or more processors and storing a tailgate control module including instructions that when executed by the one or more processors cause the one or more processors to control operation of the spindle drive to extend the spindle from the housing so that the portion of the spindle contacts an edge of the slot.

6. The tailgate control system of claim 5 wherein the tailgate control module includes instructions that when executed by the one or more processors cause the one or more processors to control operation of the spindle drive to halt extension of the spindle from the housing while the portion of the spindle contacts the edge of the slot.

7. The tailgate control system of claim 5 wherein the tailgate control module includes instructions that when executed by the one or more processors cause the one or more processors to control operation of the spindle drive to extend the spindle from the housing so that the portion of the spindle exerts a force on the edge of the slot sufficient to generate a powered closing motion of the tailgate.

8. A tailgate control system for a vehicle, the control system comprising:

a spindle drive including a housing and a spindle structured to be linearly extendible from and retractable into the housing;

a coupling member fixedly coupled to a tailgate of the vehicle, the coupling member having a slot formed therein, a portion of the spindle being coupled to the coupling member via the slot so as to enable relative movement between the portion of the spindle and the coupling member along the slot, and such that a manually-generated closing motion of the tailgate causes a change in a position of the portion of the spindle along the slot;

one or more processors; and a memory communicably coupled to the one or more processors and storing a tailgate control module including instructions that when executed by the one or more processors cause the one or more processors to:

control operation of the spindle drive to extend the spindle from the housing without rotating the tailgate so that the portion of the spindle contacts an edge of the slot responsive to a determination that the tailgate is in a predetermined rotational position; and control operation of the spindle drive to retract the spindle into the housing to lower the tailgate from the predetermined rotational position while the portion of the spindle remains in contact with the edge of the slot responsive to a command to automatically lower the tailgate.

9. The tailgate control system of claim 8 further comprising at least one switch communicably coupled to the one or more processors and configured to be actuated when the tailgate is in the predetermined rotational position, and wherein the tailgate control module includes instructions that when executed by the one or more processors cause the one or more processors to control operation of the spindle drive to extend the spindle from the housing in response to actuation of the at least one switch.

10. The tailgate control system of claim 8 further comprising at least one sensor communicably coupled to the one or more processors and configured to detect a rotational position of the tailgate, and wherein the tailgate control module includes instructions that when executed by the one or more processors cause the one or more processors to control operation of the spindle drive to extend the spindle from the housing in response to detection of the tailgate in the predetermined rotational position by the at least one sensor.

11. The tailgate control system of claim 8 wherein the predetermined rotational position is a half-latch position of the tailgate.

12. The tailgate control system of claim 8 wherein the predetermined rotational position is a fully-raised position of the tailgate.

13. The tailgate control system of claim 8 further comprising a detent mechanism structured to maintain the portion of the spindle in a predetermined location along the slot.

14. The tailgate control system of claim 13 wherein the detent mechanism comprises:

a protrusion extending from a side of the coupling member;

a link coupled to the spindle so that the coupling member is movable with respect to the link; and a spring-loaded plunger supported by the link and structured to exert a bearing force on the side of the coupling member on a side of the protrusion, and structured to resiliently deflect responsive to contact between the plunger and the protrusion during the manually-generated closing motion of the tailgate.

15. A pickup truck including a tailgate control system, the control system comprising:

a spindle drive including a housing and a spindle structured to be extendible from and retractable into the housing;

a coupling member fixedly coupled to a tailgate of the pickup truck, the coupling member having a slot formed therein, a portion of the spindle being coupled to the coupling member via the slot so as to enable relative movement between the portion of the spindle and the coupling member along the slot, and such that a manually-generated closing motion of the tailgate causes a change in a position of the portion of the spindle along the slot; and a detent mechanism structured to maintain the portion of the spindle in a predetermined location along the slot prior to generation of the manually-generated closing motion of the tailgate, wherein the detent mechanism comprises:

a protrusion extending from a side of the coupling member;

a link coupled to the portion of the spindle so that the coupling member is movable with respect to the link; and a spring-loaded plunger supported by the link and structured to exert a bearing force on the side of the coupling member along a side of the protrusion, and structured to resiliently deflect responsive to contact between the plunger and the protrusion during the manually-generated closing motion of the tailgate.

16. A vehicle including a tailgate control system, the control system comprising:

a spindle drive including a housing and a spindle structured to be linearly extendible from and retractable into the housing;

a coupling member fixedly coupled to a tailgate of the vehicle, the coupling member having a slot formed therein, a portion of the spindle being coupled to the coupling member via the slot so as to enable relative movement between the portion of the spindle and the coupling member along the slot, and such that a manually-generated closing motion of the tailgate causes a change in a position of the portion of the spindle along the slot;

one or more processors; and a memory communicably coupled to the one or more processors and storing a tailgate control module including instructions that when executed by the one or more processors cause the one or more processors to:

control operation of the spindle drive to extend the spindle from the housing without rotating the tailgate so that the portion of the spindle contacts an edge of the slot responsive to a determination that the tailgate is in a predetermined rotational position; and control operation of the spindle drive to retract the spindle into the housing to lower the tailgate from the predetermined rotational position while the portion of the spindle remains in contact with the edge of the slot responsive to a command to automatically lower the tailgate.

17. A tailgate control system for a vehicle, the control system comprising:

a spindle drive including a housing and a spindle structured to be linearly extendible from and retractable into the housing;

a coupling member fixedly coupled to a tailgate of the vehicle, the coupling member having a slot formed therein, a portion of the spindle being coupled to the coupling member via the slot so as to enable relative movement between the portion of the spindle and the coupling member along the slot;

one or more processors; and a memory communicably coupled to the one or more processors and storing a tailgate control module including instructions that when executed by the one or more processors cause the one or more processors to:

control operation of the spindle drive to extend the spindle from the housing when the portion of the spindle is in contact with an edge of the slot, to close the tailgate; and control operation of the spindle drive to retract the spindle into the housing when the portion of the spindle is in contact with the edge to restrict a backward motion of the tailgate against a force of gravity while lowering the tailgate to an open position.

* * * * *